US006532886B2

(12) United States Patent
McNamara et al.

(10) Patent No.: US 6,532,886 B2
(45) Date of Patent: Mar. 18, 2003

(54) MULTI-FUNCTIONAL CELLULAR SURFACE FOR UNDERWATER VEHICLES

(75) Inventors: George C. McNamara, South Dartmouth, MA (US); Bruce E. Sandman, Tiverton, RI (US); Bernard J. Myers, Bristol, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/861,496

(22) Filed: May 18, 2001

(65) Prior Publication Data

US 2002/0170481 A1 Nov. 21, 2002

(51) Int. Cl.[7] ..... B63G 8/00

(52) U.S. Cl. ..... 114/312; 114/316; 114/322; 114/313

(58) Field of Search ..... 114/312, 313, 114/316–322, 339, 20.1, 21.2, 22; 244/137.6, 137.1; 89/1.809, 5, 36.11, 36.12, 36.16, 36.02, 37.19

(56) References Cited

U.S. PATENT DOCUMENTS 3,818,523 A * 6/1974 Stillman, Jr. ..... 441/22
3,969,977 A * 7/1976 Opdahl et al. ..... 89/1.81
4,455,943 A * 6/1984 Pinson ..... 102/489
5,363,791 A * 11/1994 Stallard, III ..... 114/318
5,666,897 A * 9/1997 Armstrong ..... 114/20.1
5,964,175 A * 10/1999 Sirmalis et al. ..... 114/258
6,376,762 B1 * 4/2002 French et al. ..... 114/22

* cited by examiner

*Primary Examiner*—S. Joseph Morano
*Assistant Examiner*—Ajay Vasudeva
(74) *Attorney, Agent, or Firm*—James M. Kasischke; Michael F. Oglo; Jean-Paul Nasser

(57) ABSTRACT

A system of sensors and weapons in the form of individual cells forming a multi-functional cellular skin is provided to cover the outer surface of an underwater vehicle. The cells are engineered to have specific functional capabilities, e.g., acoustic sensing cells, communications cells, munitions cells, control cells and motive cells, and are electromagnetically attached to the vehicle. The functional arrangement of the cells types and the number of layers will be dependent on the desired capabilities and the overall mission of the vehicle. Cells may be deployed from the vehicle individually or in functional groups by decoupling appropriate cells from the vehicle. Once decoupled, motive cells can transport themselves and other cells as necessary, to positions remote from the vehicle. Groups of cells can be deployed to specific locations and arrayed in specific configurations by motive cells, allowing the vehicle to remain in a standoff position.

16 Claims, 3 Drawing Sheets

MULTI-FUNCTIONAL CELLULAR SURFACE FOR UNDERWATER VEHICLES

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED APPLICATIONS

There are no related patent applications.

BACKGROUND OF THE INVENTION (1) Field of the Invention

The present invention relates generally to sensors and weapons for underwater vehicles, and more particularly to a suite of cellular sensors and weapons forming an outer surface, or skin, of an underwater vehicle.

(2) Description of the Prior Art

Currently, underwater vehicles used in surveillance, target detection and acquisition and/or in defensive and offensive engagements are fitted with various sensor suites and weapons. The sensor suites may include acoustic, electromagnetic, thermal and photo-optical sensors that are, in many instances, mounted on the outer surface of the vehicle and require physical connection to the vehicle. At times, it becomes advantageous to deploy sensors or arrays of sensors at appreciable distances from the vehicle. In some instances, the sensors can be placed in areas where the vehicle could not operate so as to provide a standoff capability to the vehicle. Further, the separation between the sensors and the vehicle can provide for increased signal detection and identification. In order to deploy such sensors, they may be placed in position by the vehicle, they may be launched from the vehicle, or they may be let out from the vehicle on tethers. Placing the sensors in position exposes the vehicle to possibly hostile environments. Launching the sensors or letting them out on tethers generates acoustic transients that may subject the vehicle to detection by adversaries.

Weapons are typically carried internal to the vehicle and are launched through ports in the outer surface. Launching such weapons will typically require opening the appropriate port, ejecting the weapon into the surrounding medium and closing the port once the weapon is clear. As with sensor launching and tethering, the opening and closing of weapons ports and the ejection of the weapons generate acoustic transients that may be detectable by potential adversaries. Remote deployment of weapons from the vehicle suffers from the same concerns as does remote sensor deployment. Further, in many engagement scenarios, it may not be possible to deploy remote sensors to assist in directing the weapon to a target.

SUMMARY OF THE INVENTION

Accordingly, it is an object of the present invention to provide sensors for an underwater vehicle that can be deployed without exposing the vehicle to hostile environments.

Another object of the present invention is to provide sensors for an underwater vehicle that can be deployed while generating minimal acoustic gradients.

Still another object of the present invention is to provide weapons for an underwater vehicle that can also be deployed while generating minimal acoustic gradients.

A further object of the present invention is to provide a system of sensors and weapons for an underwater vehicle that share deployment characteristics.

A still further object of the present invention is to provide a system of sensors and weapons that can be remotely deployed and maintain communication with the vehicle and with each other.

Other objects and advantages of the present invention will become more obvious hereinafter in the specification and drawings.

In accordance with the present invention, a system of sensors and weapons for an underwater vehicle is provided that is attached to the outer surface of the vehicle. The sensors and weapons are in the form of individual cells, with each cell engineered to have specific functional capabilities, e.g., acoustic sensor cells, electromagnetic sensor cells, communications cells, control cells and munitions cells. A layer of cells is arranged on the outer surface of the vehicle and each cell is electromagnetically coupled to the surface so as to cover the vehicle. The cells form a multi-functional cellular surface, or skin, over the vehicle surface. Further layers of cells can be added over previous layers, depending on the capabilities desired. The arrangement of cells within each layer will also be dependent on the desired capabilities and the overall mission of the vehicle. For example, a vehicle used solely for surveillance may have only sensor and communications cells. Each cell has a unique identity known to the vehicle such that cells may be individually deployed from the vehicle by decoupling the identified cell from the vehicle. The unique identity also allows a cell to return to its appropriate position on the vehicle when desired. One or more types of cells are engineered to be mobile. Once decoupled, these motive cells can transport themselves and other cells as necessary, to positions remote from the vehicle. Thus the vehicle can remain clear of a hostile environment while deploying sensors and/or weapons cells into the environment.

The system described provides sensors and weapons that are deployed from an underwater vehicle with minimal acoustic gradient generation. The cells are merely electromagnetically decoupled from the vehicle, without requiring port openings or launch systems. The system includes both sensor and weapons cells that can be deployed simultaneously. By further deploying appropriate communications cells, the sensor cells communicate target location information to the weapons cells to assist in acquiring targets.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
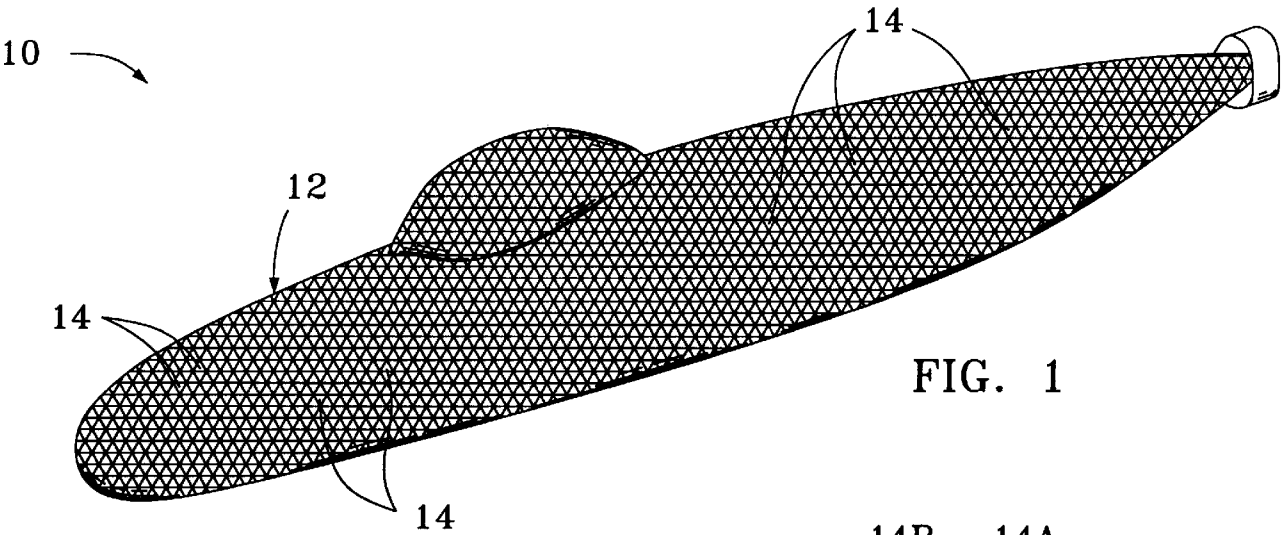
FIG. 1 is a side view of an underwater vehicle covered with a multi-functional cellular skin.

Referring now to FIG. 1, there is shown a side view of an underwater vehicle 10, covered by a skin 12 consisting of multi-functional cells 14. Cells 14 are arranged to completely cover vehicle 10 and conform to the underlying shape of vehicle 10. The cells are electromagnetically coupled to vehicle 10 and groups of cells 14 can be configured to form various arrays to provide vehicle 10 with acoustic and electromagnetic sensing, communications and weapons capabilities. When coupled to vehicle 10 as shown in FIG. 1, each cell 14 is linked to vehicle 10 in such a manner that vehicle 10 can identify the location and function of the individual cells 14. Thus, signals coming from one or more cells 14 are properly interpreted by vehicle 10. Further, electromagnetic waves can be utilized to provide power to cells 14 and to program/reprogram individual cells 14.

Figure 2:
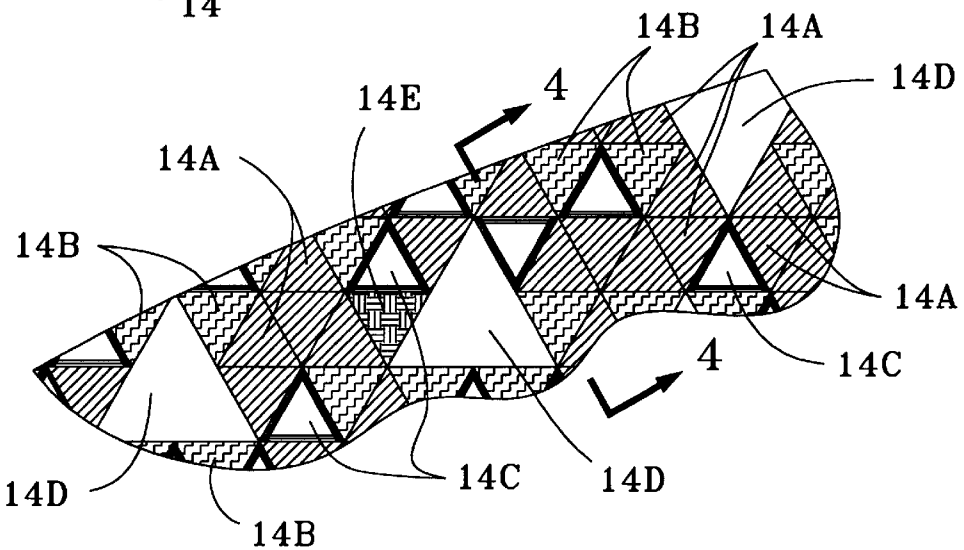
FIG. 2 is an enlarged view of a portion of multi-functional cellular skin.

FIG. 2 is an enlarged view of a portion of the skin 12 more clearly showing individual cell types 14A–14D. In the embodiment shown in FIG. 2, cells 14A are acoustic sensing cells. Cells 14A can be grouped to form acoustic sensor suites. Cells 14B are electromagnetic cells (EM cells), capable of both sensing and emitting electromagnetic signals and forming radio frequency sensor networks. Thus cells 14B can provide communications, Intelligence Surveillance and Reconnaissance (ISR) and Electronic Surveillance Measures (ESM) capabilities to vehicle 10. Cells 14C are munitions or weapons cells. Cells 14D are referred to as maternal cells that provide control to other cells, i.e., cells 14D provide communications between cells 14 and between cells 14 and vehicle 10, cells 14D may reprogram the functions of other cells 14, including activation and deactivation of other cells 14, and they may provide additional energy supply to other cells 14. Cells 14D are also mobile and can link with one or more cells 14 to transport the cells 14 to a desired location.

Figure 3:
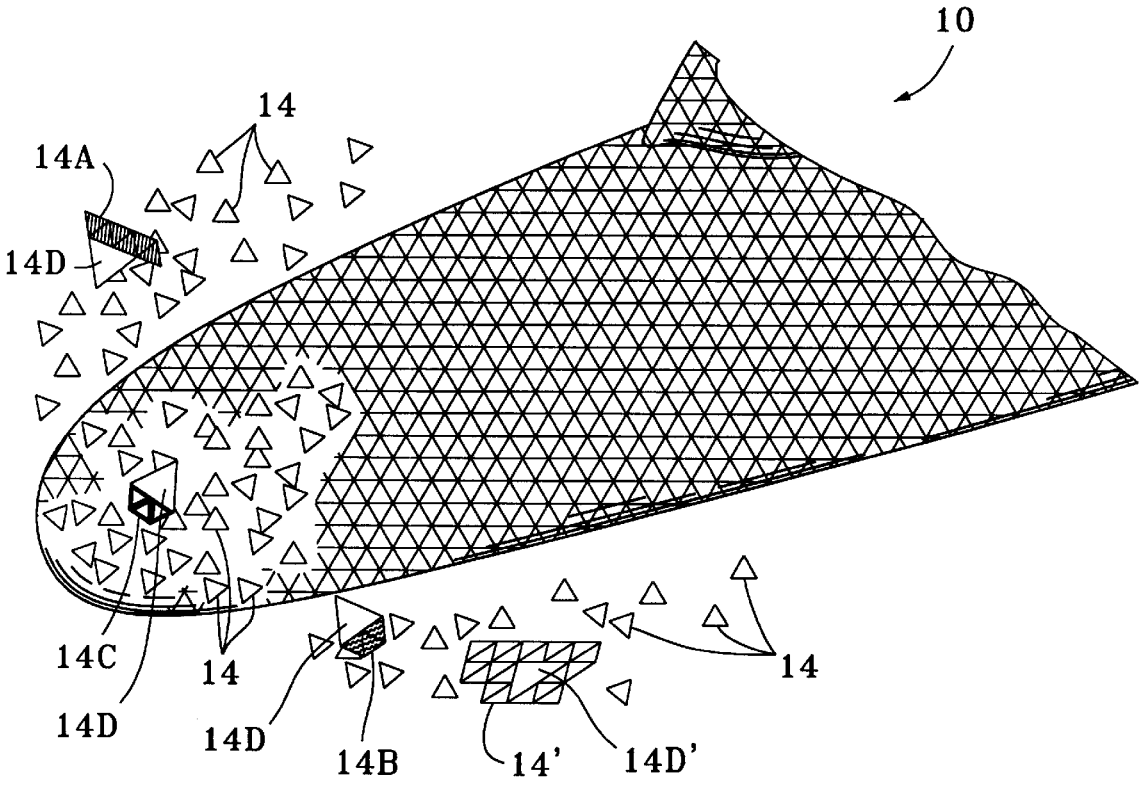
FIG. 3 is an illustrative view of a portion of the vehicle deploying a number of cell into the surrounding medium.

Referring now to FIG. 3, there is shown a large number of cells 14 being deployed from vehicle 10. Using its knowledge of the location and function of each cell 14, vehicle 10 decouples those cells 14 appropriate for the particular mission to be accomplished. If the cells 14 are decoupled as vehicle 10 is traveling through the surrounding medium, decoupled cells 14 will ablate from vehicle 10. If vehicle 10 is stationary, maternal cells 14D can be utilized to transfer other cells 14 away from vehicle 10. In either situation, vehicle 10 can deploy sensors, weapons, or communications capabilities with minimum acoustic gradient generation.

In the illustrative example of FIG. 3, the mission is to seek, identify and disable a remote threat. Thus, one or more arrays of cells 14A are released to monitor acoustic signals from the threat so as to determine its position and identify the threat based on its acoustic signature. Maternal cells 14D are released in conjunction with acoustic cells 14A to maneuver cells 14A into position and to control their operation. Maternal cells 14D may orient cells 14A so as to maximize the exploitation of environmental conditions to maximize the acoustic performance of cells 14A. Maternal cells 14D are also released in conjunction with weapons cells 14C. Once the threat is located and identified, maternal cells 14D can transport cells 14C to the threat location and control their activation, so as to disable the threat. Electromagnetic (EM) cells 14B are released to provide additional sensing capabilities and communications with vehicle 10. Maternal cells 14D may also be associated with cells 14B as necessary to transport and control cells 14B.

Another aspect of the cells 14 each having a unique identifier known to vehicle 10 relates to the attachment of skin 12 over vehicle 10. Cells 14 that have been deployed can be brought back to vehicle 10 and coupled back to vehicle 10 in their original position. In a similar manner, in first constructing skin 12 over vehicle 10, vehicle 10 may be immersed in a cell matrix. The cells 14 would couple to vehicle 10 in accordance with their known placement, thus "growing" skin 12 over vehicle 10. Additional layers can be similarly "grown".

Figure 4:
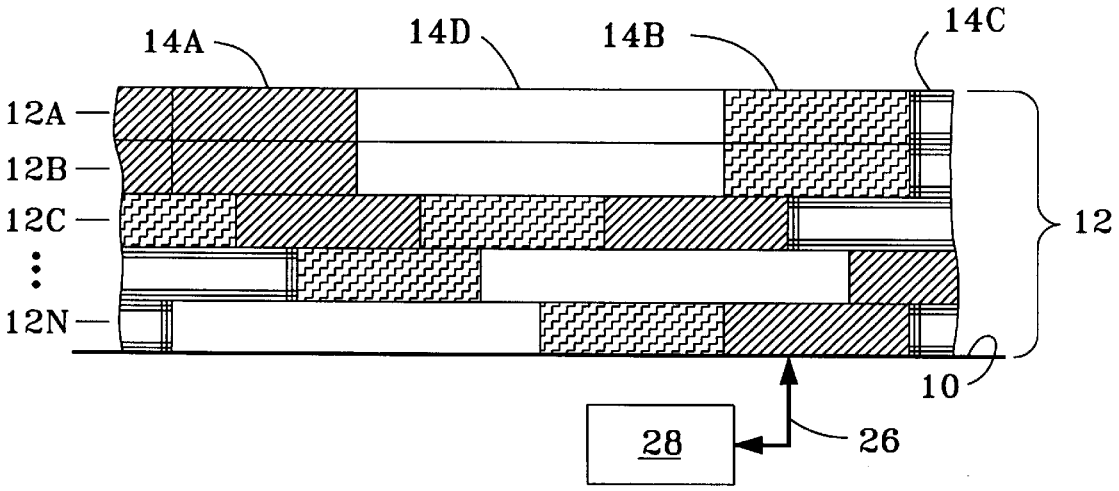
FIG. 4 is a cross-sectional view of multiple layers of multi-functional cellular skins taken at 4—4 of FIG. 2.

Referring now to FIG. 4, there is shown a partial cross-section of vehicle 10 and skin 12 taken at line 4–4 of FIG. 1. It is seen in FIG. 4 that skin 12 is composed of a number of layers 12A–12N of cells 14. Each layer 12n may have a unique distribution of cell types 14A–14D, or the cells 14 of adjacent layers may have corresponding cell types 14A–14D, as shown for layers 12A and 12B. Thus, if groups of cells 14 are deployed from layer 12A, corresponding cells in layer 12B are exposed. These corresponding cells 14 of layer 12B may then be utilized to restore full functionality to the skin 12 configuration of layer 12A. If the layers do not have corresponding cells 14, vehicle 10 can reconfigure the skin 12 functionality based on its knowledge of the locations and functions of exposed cells 14.

Figure 5A:
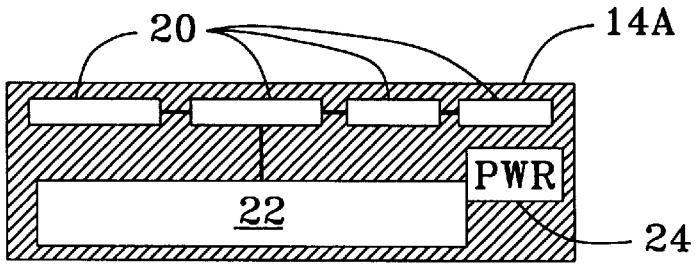
FIGS. 5A–5D are illustrative block diagrams for various cell types.

Referring to FIGS. 5A–5D, the cell types 14A–14D will be described in further detail. FIG. 5A illustrates an acoustic cell 14A. Cell 14A includes one or more acoustic sensors 20, an electronics module 22 and an acoustic power module 24. When cell 14A is coupled to vehicle 10, sensors 20 and electronics module 22 operate generally in the manner of existing hull mounted acoustic sensors and their associated electronics. The electromagnetic coupling of cell 14A with vehicle 10 (as indicated by double arrow 26 in FIG. 4) provides the linkage between cell 14A and signal processing modules 28 in vehicle 10 (FIG. 4). However, when decoupled from vehicle 10, electronics module 22 provides a link between cell 14A and one or more maternal cells 14D. As noted previously, each cell 14 has a unique identifier. The identifier is maintained within electronics module 22 such that outgoing signals are coded with the identifier and only linkages having the proper identifier for cell 14A can be established. In order to minimize the cost and complexity of cells 14, self-contained processing is minimized. Thus, in a preferred embodiment, each acoustic cell 14A is tuned to a particular threat frequency band. Upon sensing a signal in the band it is tuned to, an acoustic cell 14A sends an active acoustic signal to its associated maternal cell 14D to alert maternal cell 14D of the detection.

Figure 5B:
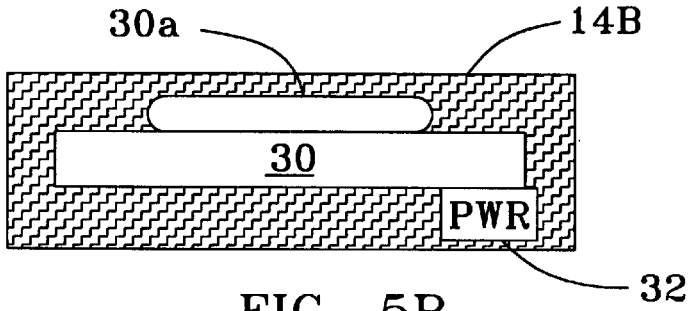

Cell 14B, as illustrated in FIG. 5B, includes sensor/emitter 30 and EM power module 32. As with acoustic cell 14A, the cell identifier is maintained within the electronics of sensor/emitter 30. Sensor/emitter 30 further detects changes in magnetic fields, with the detection threshold adjusted to be sensitive to changes indicative of a large, metallic, underwater body. For communications, ISR and ESM capabilities, EM cell 14B would need to be on the surface of the water. Thus, cell 14B may further include flotation device 30*a*, which, when activated, causes cell 14B to float to the surface. Flotation device 30 may be any well-known device, such as flotation bag inflated by a solenoid-activated compressed air cylinder. Once on the surface, sensor/emitter 30 can provide short burst emissions for satellite communications, or communications to other nearby platforms. As with cells 14A arrayed beneath the surface, cells 14B may be arrayed on the surface to form a floating aperture capable of robust transmissions.

Figure 5C:
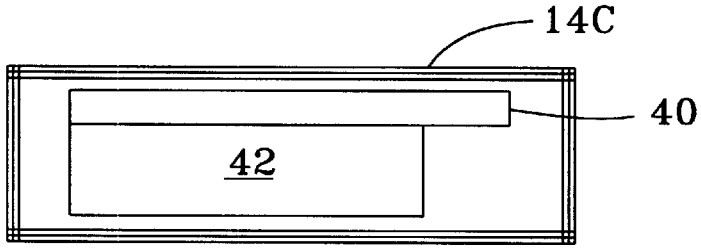

Referring to FIG. 5C, cell 14C, as illustrated therein, includes weapons sensor/trigger 40 and munitions 42. Sensor/trigger 40 operates in the manner of existing munitions triggers, e.g., proximity sensors, magnetic sensors, pressure sensors, etc. Additionally, sensor/trigger 40 maintains the unique identifier for cell 14C, such that it is responsive to signals from vehicle 10 or maternal cells 14D having the proper identifier. Upon sensing the appropriate signal, either directly from the environment, from vehicle 10 or from a maternal cell 14D, sensor/trigger 40 causes munitions 42 to activate.

Figure 5D:
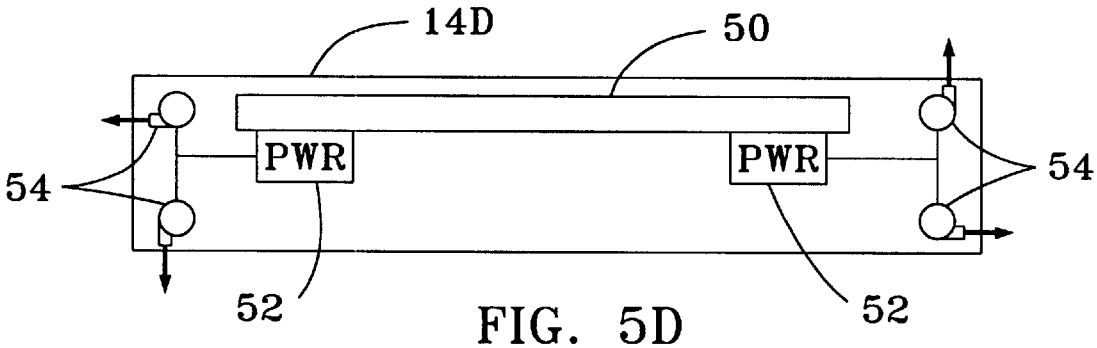

FIG. 5D illustrates a maternal cell 14D. Maternal cell 14D includes communications module 50, one or more maternal power modules 52 and one or more thrusters 54. Communications module 50 maintains communication with other cells 14 and serves as the main link to vehicle 10 for a group of cells 14 under control of maternal cell 14D. Module 50 maintains the unique identifier for cell 14D and further includes command-processing capabilities to interpret and carry out instructions from vehicle 10, as well as maintain an internal clock. For the scenario previously described, module 50 would store the unique identifiers for the cells under its control, thus enabling communications with each cell that can be both time and identifier stamped. The processing capabilities of module 50 allow control of thrusters 54 to properly position the group of cells 14 for the mission received from vehicle 10. For example, FIG. 3 illustrates a group of cells 14' released from vehicle 10 and under the control of maternal cell 14D'. During transport to their final positions, cells 14' are electromagnetically coupled to maternal cell 14D'. Maternal cell 14D', together with coupled cells 14', proceeds to the mission location as directed by vehicle 10. As each of the cells 14' arrives at its directed location, it is decoupled from maternal cell 14D'. The remaining coupled cells are then transported to the next cell location until all cells are properly positioned. The processing capability of module 50 would include inertial guidance capabilities such that no communication with vehicle 10 is needed to accomplish the cell placements once the group of cells 14' have decoupled from vehicle 10. Maternal communications module 50 further receives and relays signals between vehicle 10 and cells 14'.

As previously mentioned, processing capabilities of cells 14 would need be minimized to reduce costs and complexity of cells 14. Referring to the example of FIG. 3, a maternal cell 14D would receive a detection alert from one or more cells 14A. Onboard processing at module 50 would limit false alarms by only relaying the threat alertment to vehicle 10 after a pre-determined threshold of alertments from a pre-determined number of cells 14A. The threat alertment to vehicle 10 would include the location of the cells 14A and the threat frequency band detected.

The invention thus described is system of sensors and weapons for an underwater vehicle. The sensors and weapons are in the form of individual cells and are electromagnetically attached to the outer surface of the vehicle, forming a skin about the vehicle. Each cell is engineered to have specific functional capabilities, e.g., acoustic sensor cells, electromagnetic sensor cells, communications cells, control cells and munitions cells. The arrangement of cells and the number of layers of cells depend on the capabilities desired. Each cell has a unique identity known to the vehicle such that cells may be individually deployed from the vehicle by decoupling the identified cell from the vehicle. Deployment of the cells does not require any port openings or launch system, as the cells are electromagnetically decoupled from the vehicle and allowed to ablate from the surface. Groups of cells can be deployed to specific locations and arrayed in specific configurations by motive cells, allowing the vehicle to remain in a standoff position. The ability to arrange sensor cells into desired configurations remote from the vehicle allows the formation of variable aperture arrays, enhancing the vehicle's sensing capabilities.

Although the present invention has been described relative to a specific embodiment thereof, it is not so limited. Cells 14 have been illustrated having a triangular shape. It is understood that the shapes and sizes of individual cells 14 may be varied to suit the vehicle 10 and its functionality. The listing of cell types is not intended to be exhaustive. Cell types may be combined into single cells or functionalities may be added to cells, e.g., acoustic cells 14A may be provided with thrusters 54, or sensors 20 may include velocity, temperature, optical, or other sensing capabilities. Additionally new cell types, such as countermeasure cells 14E (FIG. 2), can be fabricated for specific needs. FIG. 4 depicts multiple layers 12A–12N of skin 12 and FIG. 1 illustrates skin 12 fully covering vehicle 10. The number of layers as well as the extent of each layer may also be varied to suit the expected mission of the vehicle and to suit specific vehicle configurations.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system providing a vehicle with enhanced capabilities comprising a plurality of cellular devices individually coupled to the vehicle and at least partially covering an outer surface of the vehicle, each device displaying at least one of a sensing, communications, control and weapons capability, each device being in communication with the vehicle to impart its capability to the vehicle, each device individually deployable from the vehicle to remotely provide the vehicle with its capability, wherein at least one of said cellular devices displaying control capability is deployed with a plurality of other of said cellular devices to form a group of devices, the control capability device affecting movement of each device within the group to form at least one of a sensing array, a communications array and a munitions array remote from the vehicle.

2. The system of claim 1, wherein each device has a unique identifier known to the vehicle, the identifier for each individual device being associated with the location of the individual device on the vehicle and the capability of the individual device.

3. The system of claim 2, wherein the weapons capability device further comprises:

a munitions module; and a trigger to activate the munitions module and maintain the identifier of the device.

4. The system of claim 1, wherein the cellular devices are coupled to the vehicle in multiple layers.

5. The system of claim 1, wherein each device is individually recoupled back to the vehicle after deployment.

6. The system of claim 1, wherein the devices are electromagnetically coupled to the vehicle.

7. The system of claim 6, wherein the electromagnetic coupling further comprises electromagnetic communications between the vehicle and the devices.

8. A system providing a vehicle with enhanced capabilities comprising a plurality of cellular devices individually coupled to the vehicle and at least partially covering an outer surface of the vehicle, each device displaying at least one of a sensing, communications, control and weapons capability, each device being in communication with the vehicle to impart its capability to the vehicle, each device individually deployable from the vehicle to remotely provide the vehicle with its capability and each device having a unique identifier known to the vehicle, the identifier for each individual device being associated with a location of the individual device on the vehicle and the capability of the individual device, wherein the sensing capability device further comprises:

at least one acoustic sensor detecting acoustic signals from an environment surrounding the device;

a sensing processing module maintaining the identifier of the device, processing the signals from the at least one sensor and communicating the processed signal to the vehicle; and a sensing power module providing operating power for the at least one sensor and the sensing processing module.

9. A system providing a vehicle with enhanced capabilities comprising a plurality of cellular devices individually coupled to the vehicle and at least partially covering an outer surface of the vehicle, each device displaying at least one of a sensing, communications, control and weapons capability, each device being in communication with the vehicle to impart its capability to the vehicle, each device individually deployable from the vehicle to remotely provide the vehicle with its capability and each device having a unique identifier known to the vehicle, the identifier for each individual device being associated with a location of the individual device on the vehicle and the capability of the individual device, wherein the communications capability device further comprises:

a communications module maintaining the identifier of the device and sensing changes in magnetic fields surrounding the device; and a communications power module providing operating power for the communications module.

10. The system of claim 9, wherein the communications capability device further comprises:

a floatation means to bring the communications capability device to a surface, the floatation device receiving operating power from the communications power module; and a burst module within the communications module to provide satellite communications when the communications capability device is on the water surface.

11. A system providing a vehicle with enhanced capabilities comprising a plurality of cellular devices individually coupled to the vehicle and at least partially covering an outer surface of the vehicle, each device displaying at least one of a sensing, communications, control and weapons capability, each device being in communication with the vehicle to impart its capability to the vehicle, each device individually deployable from the vehicle to remotely provide the vehicle with its capability and each device having a unique identifier known to the vehicle, the identifier for each individual device being associated with a location of the individual device on the vehicle and the capability of the individual device, wherein the control capability device further comprises:

a control module maintaining the identifier of the module, communicating with other devices, communicating with the vehicle, processing commands issued from the vehicle, forwarding the processed commands to other devices, processing signals from other devices, tracking its geometric position through an inertial guidance system and controlling its movement;

at least one thruster, each thruster controlled by the control module to effect the movement of the control capability device; and a control power module providing operating power for the control module and the at least one thruster.

12. The system of claim 11, wherein the sensing capability device further comprises:

at least one acoustic sensor detecting acoustic signals from an environment surrounding the device;

a sensing processing module maintaining the identifier of the device, processing the signals from the at least one sensor and communicating the processed signal to the vehicle; and a sensing power module providing operating power for the at least one sensor and the sensing processing module.

13. The system of claim 12, wherein the weapons capability device further comprises:

a munitions module; and a trigger to activate the munitions module and maintain the identifier of the device.

14. The system of claim 13, wherein the communications capability device further comprises:

a communications module maintaining the identifier of the device, sensing changes in magnetic fields surrounding the device and emitting burst communications to a satellite;

a communications power module providing operating power for the communications module.

15. The system of claim 14, wherein at least one control capability device is deployed with a plurality of other devices to form a group of devices, the control capability device affecting movement of each device within the group to form at least one of a sensing array, a communications array and a munitions array remote from the vehicle.

16. The system of claim 12, wherein:

the control capability device is deployed with a plurality of sensing capability devices;

each of the sensing processing module is tuned to a predetermined threat frequency band;

each sensing processing module communicates an alert signal to the control module when a signal is detected in the frequency band;

the control module processes the alert signals; and the control module relays a threat alert to the vehicle when a pre-determined threshold of alert signals have been received from a pre-determined number of sensing processing modules.

* * * * *